United States Patent [19]

Mirabile

[11] Patent Number: 4,527,585

[45] Date of Patent: Jul. 9, 1985

[54] AUTOMATIC BEVERAGE TUBE CLEANER

[76] Inventor: Paul J. Mirabile, 100 Sparango La., Plymouth Meeting, Pa. 19462

[21] Appl. No.: 506,859

[22] Filed: Jun. 22, 1983

[51] Int. Cl.[3] ..... B08B 3/04; B08B 9/06

[52] U.S. Cl. ..... 137/240; 134/166 C; 134/169 C; 137/565; 222/148

[58] Field of Search ..... 137/238, 240, 565; 134/166 C, 169 R, 169 C; 222/148

[56] References Cited

U.S. PATENT DOCUMENTS

| | | | |
|---|---|---|---|
| 932,284 | 8/1909 | Jones | 137/238 |
| 1,993,371 | 3/1935 | Jones | 134/169 X |
| 2,023,854 | 12/1935 | Petricone | 134/169 X |
| 2,078,740 | 4/1937 | Stahl | 134/169 X |
| 2,092,257 | 9/1937 | Lewis | 222/148 X |
| 2,178,559 | 11/1939 | Cohen et al. | 137/240 |
| 2,458,230 | 12/1949 | Warcup | 222/148 X |
| 2,645,379 | 7/1953 | Audia | 222/148 X |
| 2,809,650 | 10/1957 | Anderson | 137/565 |
| 2,906,435 | 9/1959 | Nichols | 222/148 X |
| 2,939,466 | 6/1960 | Hill | 134/169 |
| 3,025,863 | 3/1962 | Eberle | 134/169 X |
| 3,120,326 | 2/1964 | Hedeman | 222/148 X |
| 3,278,961 | 10/1966 | Svensson | 134/169 X |
| 3,441,034 | 4/1969 | Burks | 134/169 X |
| 3,498,502 | 3/1970 | Breitenstein et al. | 222/148 X |
| 3,572,367 | 3/1971 | Reich | 222/148 X |
| 3,833,417 | 9/1974 | Griparis | 134/169 X |
| 3,916,923 | 11/1975 | Branton | 134/169 X |
| 3,945,411 | 3/1976 | Skoli et al. | 134/169 X |
| 4,168,677 | 9/1979 | Brown | 134/169 X |

*Primary Examiner*—George L. Walton

*Attorney, Agent, or Firm*—Steele, Gould & Fried

[57] ABSTRACT

An automatic beverage tube cleaner especially applicable to beer distribution coils includes controllable valves for isolating individual pressurized beverage sources from their respective conduits and for connecting the conduits together to a discharge pump, the pump being of a type which defines an open discharge path whether or not the pump is operating, a vacuum fitting connected to a source of cleaning solution for drawing the cleaning solution into the conduits, and a system of supply valves for sequentially flushing the conduits with cleaning solution and clean rinse water. An automatically-actuated controller initiates operation in off-hours, providing a self-cleaning maintenance-free beverage delivery system.

10 Claims, 6 Drawing Figures

AUTOMATIC BEVERAGE TUBE CLEANER

BACKGROUND OF THE INVENTION

1. Field of the Invention

This invention relates to conduit cleaning systems, and especially to an electric and water-pressure powered, automatically-operable beer coil and conduit cleaner 2. Description of the Prior Art The usual beverage delivery system comprises a source of the beverage, for example a keg of beer, a source of pressure, for example a container of compressed carbon dioxide, and a conduit to carry the beverage to a discharge point having a manually activated spigot. In order to discharge a beverage at an appropriate temperature for drinking, the beverage source may be stored in a temperature-controlled area, or the beverage-carrying tube may be passed through such an area, thereby bringing the beverage to desired temperature. In taverns, the system frequently takes the form of a refrigerated room for storage of kegs, and a system of permanent tubes or conduits for connecting the kegs to distribution spigots at a customer area.

Draft beer from the keg is an unpasteurized material which is surprisingly sensitive to rough handling. Discontinuities in pressure and temperature encountered by the beer may cause unacceptable foaming, and may adversely affect the taste and aroma. During brewing, the brewmaster, of course, has various means of controlling the chemical and physical environment of the processed materials. In order to ensure correct taste, aroma and appearance, similar care must be taken with the beverage delivery system.

In addition to the care which must be taken to maintain the optimum taste aroma and appearance, correct sanitation requires that the beverage delivery system be as clean as possible. Under some circumstances, the organic materials present in the beer may chemically react or decompose, and so-called beer stones may precipitate out in the conduit system. Unless the conduits are kept clean, microbial action can occur which degrades the beer.

The most frequently encountered beverage delivery systems in devices for heat exchanged delivery employ a heat transfer section along the beverage delivery conduit, which heat transfer section is located in a refrigerated area. The kegs may or may not also be kept refrigerated. Relatively warner beer from a keg is conveyed along a conduit to the heat transfer passage, immediately preceding the spigot. It will be appreciated that the heat transfer section, which normally takes the form of a helical coil of metal tubing, introduces both a physical discontinuity and a temperature discontinuity encountered by the beverage being conveyed through the conduit. Such systems therefore may be expected to cause foaming of the beer, and to produce variations in beverage treatment (e.g., variations in output temperature) as a function of the rate of discharge of beverage.

Beverage delivery systems employing heat transfer coils are also more susceptible to accumulations of unwanted materials than are simple conduit sections of systems in which the kegs themselves are stored in a temperature controlled area. Nevertheless, both types of beverage delivery systems must be regularly cleaned both to provide a good beverage and to comply with relevant health codes.

Conduits may be cleaned by flushing with cleaning fluid and water. Having added a cleaning fluid manually, early conduit cleaning systems employ water pressure to fill conduit systems with water, and then a manually-operated pump device to surge and agitate the cleaning solution within the conduit, thereby loosening foreign materials. The conduits are then opened and gravity drained. U.S. Pat. Nos. 1,993,371 Jones; 2,023,854 Petricone; and 2,078,740 Stahl involve such devices. In order to function, an agitation device of this kind must employ either a circular path around which the fluid is agitated, or a substantial length of conduit must be involved such that a surging flow can be accommodated in a closed section. The aforesaid patents to Jones and Petricone teach cleaning a pair of adjacent beverage delivery tubes at the same time by connecting them in a loop. In order to accomplish the connection, the beverage tubes are removed from their kegs and connected together at the keg storage area; and, the pump is connected between the distribution spigots at opposite end of the tubes being cleaned. A third connection to a source of water allows the flushing system to be charged with water, after which the user operates the pump to force the water around the circular passage created by the connection of conduits. The requirement of connection presents a danger of spillage which is a serious problem in a refrigerated storage area. Such connections likewise do not lend themselves to automatic operation.

The cleaning device of Stahl is somewhat more simple in that the manually-operated pump functions on a first stroke to draw cleaning fluid into the pump chamber, and in a second stroke to discharge the pump fluid into the beverage coil conduit. The fluid is alternately surged into the beverage coil and drawn back into the pump, finally being discharged into a reservoir. Unless the spigot is opened during cleaning, the flow is necessarily directed into a closed conduit, and substantial conduit length is necessary before appreciable surging of cleaning fluid will occur. Moreover, in such system, the surging will occur only in a portion of the conduit close to the pump. Alternatively, if the spigot is opened to prevent development of pressure which would resist fluid flow, a portion of the surging fluid escapes through the spigot.

U.S. Pat. Nos. 2,092,257 Lewis; 2,906,435 Nichols; and 3,441,034 Burks employ pumps to provide the necessary surging of cleaning fluid. Similarly, U.S. Pat. Nos. 2,458,230 Warcup and 2,645,379 Audia appear to rely upon fluid pressure and/or air pressure to achieve cleaning fluid motion. In Lewis, fluid motion is assisted by the necessity of connecting neighboring keg lead lines together, forming a loop. A number of the subsequent devices include manually-operated valves adjacent the keg or the spigot. None of the devices can be expected to operate upon automatic initiation or with a convenience approaching that of the present invention. The invention can be operated entirely without human intervention. The individual kegs need not be disconnected in order to clean the conduit, thereby risking a spill. The kegs are isolated automatically upon operation of the cleaning system and the contents of the conduits are drained under control. The invention further allows so-called lead lines between the kegs and the conduit cleaning system to be safely and conveniently cleaned, for example when replacing an empty keg with a full one. The lead line need only be momentarily connected across fittings provided for that purpose, and flushed. The only manual intervention which is therefore required by the system of the invention is the inescapable need for replacing empty kegs with full ones. The result is a conduit system which is automatically cleaned during off-hours, and which is as clean as practicable from the keg to the spigot.

SUMMARY OF THE INVENTION

It is an object of the invention to achieve the maximum convenience in cleaning a beverage delivery system, at minimum expense.

It is also an object of the invention to adapt the permanently-installed conduit system of a walk-in keg storage cooler to an electrically controlled conduit cleaner.

It is another object of the invention to provide a beverage conduit cleaner which is self-contained and may be conveniently inserted immediately between keg connections and conventional beverage delivery systems.

These and other objects are accomplished by an automatic beverage tube cleaning apparatus for a beverage delivery system of the type having at least one conduit for carrying the beverage from a pressurized beverage source to an output, the apparatus comprising a first valve controllably closable to isolate the beverage source from the conduit, a pump and pump valve, controllably openable to connect the conduit to the drain, and also operable to forceably discharge the conduit to the drain, a second valve connecting the conduit and a pressurized clean water source, the second valve being controllably operable to flush the conduit with clean water, a third valve and associated check valve connecting the conduit to an unpressurized cleaning solution reservoir, the check valve passing cleaning solution to the third valve and to the conduit when subjected to vacuum in the conduit due to the pump and/or passage of fluid, and a controller electrically connected to the pump and first, second and third valves, the controller sequencing pump and valve operation to isolate the conduit from its respective beverage source, and to alternately flush and drain the conduit with cleaning solution and with clean water.

BRIEF DESCRIPTION OF THE DRAWINGS

There are shown in the drawings the embodiments which are presently preferred. It should be understood, however, that the invention is not limited to the precise arrangements and instrumentalities shown in the drawings wherein.

DETAILED DESCRIPTION OF THE PREFERRED EMBODIMENTS

Figure 1:
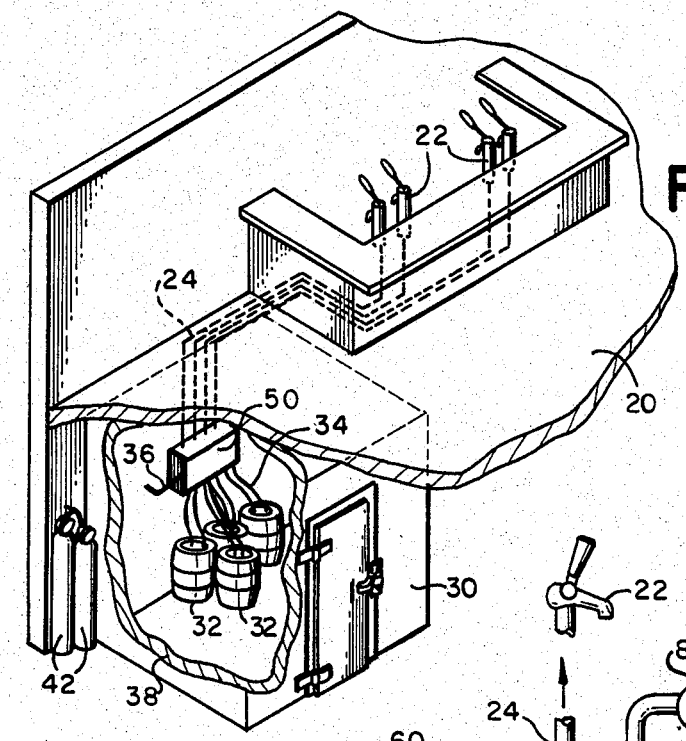
FIG. 1 is a perspective cutaway view of a two-story tavern and keg storage arrangement, the kegs being connected to a conduit cleaner according to the invention.

The overall environment of the invention is shown in FIG. 1. In order to convey a cold beverage to a distribution point, a cold storage area in which supplies of the beverage are stored is connected via permanently-installed conduits 24 to the beverage distribution points. A walk-in refrigerator 30 of substantial size is located in another part of the building from tavern 20, for example in the basement of the building. The beverage containers 32 are pressurized, for example by means of compressed gas supply 42. Under pressure, the liquid beverage carried by flexible tubes 34 and conduits 24 from kegs 32 is released into glasses, pitchers and the like at distribution spigots 22, by merely opening the spigots when needed. A flow rate of approximately one gallon per minute per beverage tube is considered to be adequate for most installations.

Tavern operators may desire to store kegs 32 in the same walk-in refrigerator 30 that is used to store other materials. If a restaurant, food may be stored in the refrigerator, or even if the establishment operates solely as a beverage supplier, package beverages may be stored in the same refrigerator. Any additional storage needs restrict the available space for kegs 32. Moreover, any spills of beer in the refrigerator could affect the taste or smell of the materials stored there, or freeze on the floor, making access difficult. The danger of spills is aggravated because efficiency of cooling requires that the internal dimensions of walk-in refrigerator 30 be as small as practicable for storing an adequate supply of kegs. Appropriate insulation 38 slows the passage of heat through the walls.

Even with a powerful and precisely controlled refrigeration unit for walk-in area 30, substantial temperature variations can be expected in some circumstances. Successive shift operators may determine that the beverage is too cold or too warm, and adjust the set point of the temperature control. As kegs 32 are exhausted and removed, and when full warm kegs are brought into refrigerator 30, varying loads further complicate matters. It therefore occasionally happens that the temperature control will be set so low as to freeze the beverage in conduits 24.

When the beverage is beer, which is not only unpasteurized, but is highly sensitive to discontinuities in temperature, physical shock and the like. Ice in conduits 24 is just such a discontinuity causing an excessively foamy output at spigots 22. If allowed to remain at low temperature, a form of beverage slush fills conduits 24 and must be removed in order to achieve sufficient flow through the lines. Of course, when frozen solid, there is no possibility of using the corresponding spigot.

Figure 2:
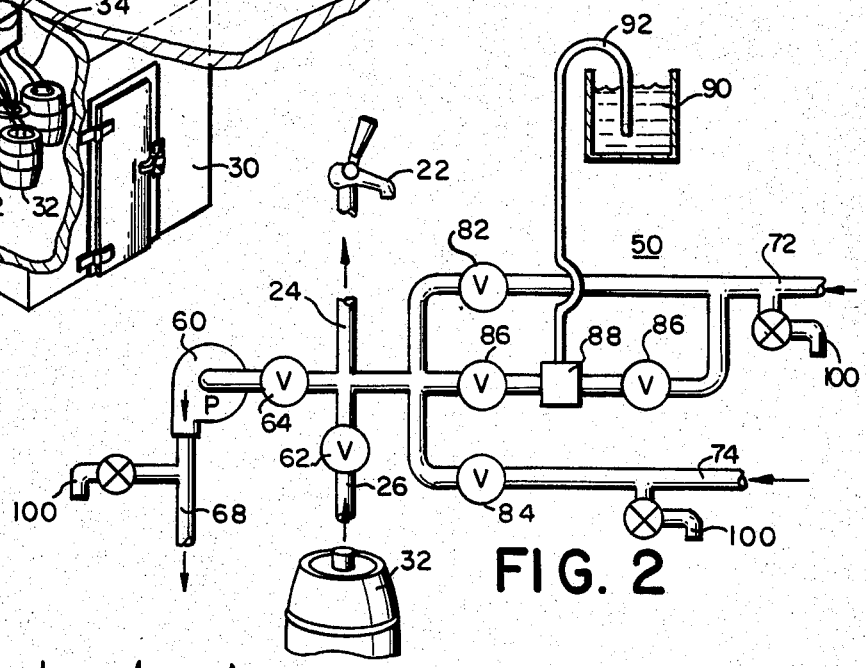
FIG. 2 is a schematic diagram of the cleaning device of the invention, including one beverage delivery tube.
Figure 3:
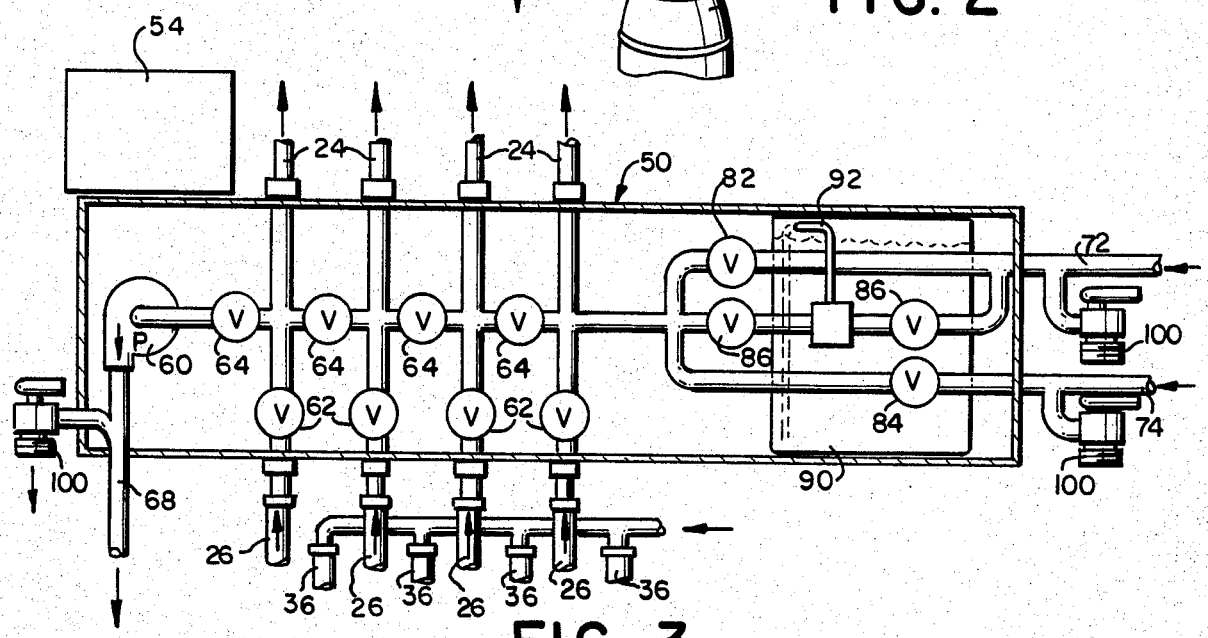
FIG. 3 is a schematic view of the system of the invention, including four beverage delivery tubes.

As shown in partial schematic in FIG. 2, the invention comprises a complete automatic conduit cleaning system which will function to remove unwanted material, even including ice, as well as to regularly clean and sanitize the beverage delivery conduits 24. FIG. 2 schematically indicates the connection of beverages and water supplies, valves, pump and drain, for a one-conduit system. The system is likewise useful for multiple-conduit systems. FIG. 3 shows an analogous layout for four beverage conduits.

Although the system may be embodied for one or a plurality of separate beverage conduits 24. The conduit cleaning device is preferably adapted to simultaneously act upon all the conduits 24 at once, rather than individual conduits separately. Addition of further conduits therefore only requires minimal additional parts and connections. Should conduits of substantially different length or cross-section be included in one system, it may be desirable to adapt the system to clean the conduits in successive cycles or even singly. The system may be timed and dimensioned for conduits of various lengths, in order to compensate for the added time which will be required to fill or drain a longer conduit or one of restricted diameter.

The cleaning system conduits are preferably the same diameter as the remaining system conduits, whereby vortices and eddies in the conduits are minimized. Discontinuities, obstructions and ragged fittings are preferably avoided. The system of the invention employs standardized fittings for water supplies and drain, but as to the beverage tubes 26 and conduits 24, the parts come in a range of standard fittings. In this manner, constant diameter flowpaths are provided for the beverage.

As shown in FIG. 2, lead beverage tube 26 may be isolated from conduit 24 by means of solenoid valve 62. As a first step, valve 62 (or a plurality of valves 62) are closed to prevent any water or cleaning solution from entering the beverage kegs. In the next step, solenoid valve(s) 64 are opened to connect conduits 24 to pump 60 and thereafter to a drain. Pump 60 is of a type through which air or fluid can pass when the pump is not running, for example a centrifugal pump or a peristaltic pump in which no fluid seal is formed. Therefore, upon opening valve 64, air flows backward from the drain through pump 60 and the contents of conduit 24 run through pump 60 to the drain. To allow entry of air, drain pipe 68 has no bend forming a trap, and fits loosely into a further drain line (not shown) such that air can enter. In order to more completely drain the conduit, and further in order to develop a vacuum in the system, pump 60 is preferably activated concurrently with or during the drain cycle.

After a suitable interval as necessary to drain conduit 24, with or without operation of pump 60, solenoid valves 86 are opened to connect hot water supply 72, through valve 88, to conduits 24. Valve 88 operates only one way, namely to pass cleaning solution to the water line, but not vice-versa. The passage of hot water under pressure through valve 88 produces a vacuum which has the effect of siphoning cleaning solution from reservoir 90, through draw tube 92. A suitable cleaning solution is concentrated sodium metasilicate. The hot water/cleaning solution mixture is forced by the water pressure into conduits 24. According to the invention, the pump 60 is preferably operated to cause an additional vacuum in conduits 24 upon draining the system, whereby an added concentration of cleaning solution from reservoir 90 is drawn directly by the vacuum through valve 88. The incoming hot water therefore carries along a high concentration of cleaning solution at the leading edge. The vacuum caused by the pump together with the pressure of the incoming water cause a turbulence and surging which carries the cleaning solution far up in the conduits 24, up to spigots 22.

The conduit(s) 24 being charged with hot water and cleaning solution, valves 86 are then closed and pump 60 is activated to drain the system, again producing a vacuum. After one or more cycles of flushing with cleaning solution and draining, the same procedure is undertaken with hot water but not cleaning solution, i.e., to rinse the conduits. In this phase, hot water from source 72 is introduced through valve 82, bypassing valve 88. After one or more hot water flushes and drainings, one or more final cold water flushes is applied through valve 84.

Following a number of successive cycles of flushing and draining with hot water carrying a cleaning solution, then with clean hot water, a similar cycle is undertaken using valve 84, connecting conduits 24 to cold water source 74.

By virtue of cleaning and/or flushing with hot water, accumulations of ice can be quickly and easily removed. Although the "slush" form of ice is, of course, more easily flushed from the lines, the surging hot water will also tend to warm the entire conduit, melting the ice. For efficiency and to employ the highest temperature of hot water, supply line 72 should be insulated inside walk-in refrigerator 30. The cold water supply 74 need not be insulated. Conduits 24 should not be insulated within refrigerator 30, maximizing cooling, but should be insulated outside refrigerator 30 to minimize condensation and maintain low temperature.

Two separate fittings are required to each of kegs 32, as is conventional in beverage delivery systems. Each keg is connected via a lead beverage tube 26 and a compressed gas supply line 36. At the connection to keg 32, both lines are frequently mounted in a standardized fitting. Similar standardized fittings may be employed to connect conduit cleaning system 50 to each of the incoming lead beverage tubes. The remaining tube connections are preferably made permanent, for example, using thermally conductive copper pipes and soldered fittings, or compression fittings as known in the art.

From time to time, kegs 32 will be emptied and must be replaced with full kegs. Upon changing a keg, preferably for another pre-cooled keg, the user need only disconnect the standardized keg fitting, exchange kegs and reconnect the fitting. In order to clean the entire length of the beverage supply conduits, the invention further comprises means for cleaning the lead beverage tube. As shown in FIGS. 2 and 3, fittings 100, connected respectively to the hot water supply 72, cold water supply 74, and drain 68, allow the user to momentarily connect the lead beverage tube from a keg being exchanged to the conduit cleaning system. The fittings 100 include manually-operable valves, by which the user connects cleaning water to the lead beverage tube and discharges the same through the drain. It will be appreciated that the drain requires a manual valve as well as do the supplies, in order to prevent escape of discharged fluid being impelled through the drain by pump 60. Manually operable valves, or alternative electric controls for the solenoid valves (not shown) may be desirable to prevent escape of beverage from beverage tubes 24 and/or compressed gas from lines 36, when changing kegs.

As shown in FIG. 3, a pair of valves 86 are employed around the suction valve 88 which extracts cleaning solution from reservoir 90. Although a single valve could be employed to allow the passage of hot water from source 72 to valves 64, it is presently preferred that suction valve 88 be isolated between simultaneously-operated valves, to thereby prevent the introduction of even trace amounts of cleaning solution into the rinse water.

The sequencing of operation may be controlled by a packaged controller 54, or by a relay-based or stepping switch system. It is presently preferred that a solid state controller be used to actuate the valves and pump in sequence, and to determine the appropriate delays.

Figure 4:
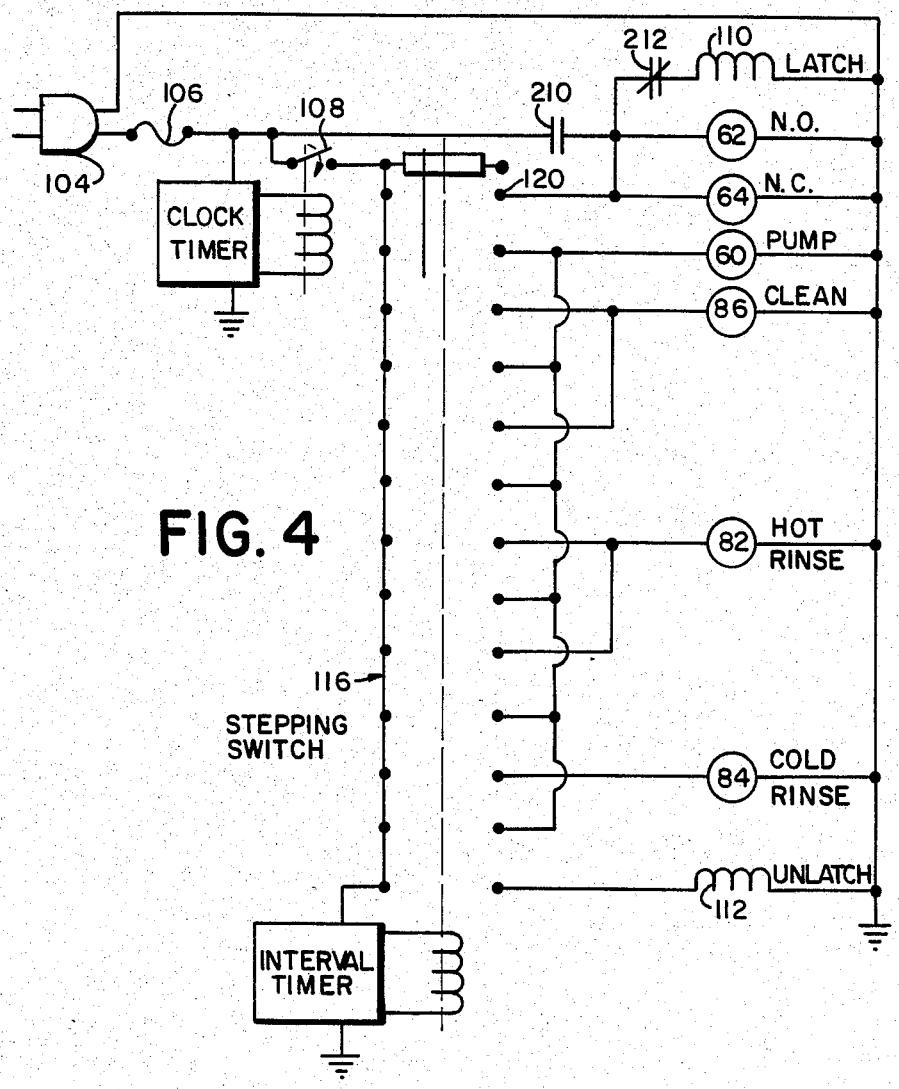
FIG. 4 is a schematic diagram showing an electric control for the system.

Available controllers are also adaptable to various selectable operation schemes. Suitable programmable controllers for operation of solenoid valves and the like are known in the art and available from companies such as Texas Instruments, Allen Bradley Corp., and the like. A suitable programmed sequence, or a sequence which can be executed using a simple stepping switch and relays, is shown in FIG. 4. In FIG. 4, the coils of the respective solenoid valves are indicated by numbered circles. It should be appreciated that the representation of FIG. 4 is a schematic indication and various additional circuits could be employed to reach a similar function.

As powered by power source 104, preferably through fuse 106, the system may be manually actuated by closure of contacts 108, and/or the contacts may be closed and the system initiated by a clock. Clock operation is preferred in order to allow the system to cycle during off-hours, because the beverage delivery and conduit cleaning systems cannot be operated simultaneously. Alternatively, or in addition, a key-controlled switch can be used to preclude accidental operation.

The initial operation is to close each of valves 62, thereby isolating the kegs, and simultaneously to open discharge valves 64, allowing the conduits 24 to drain. In order to keep the beverage delivery system operational in the event of a power failure, valves 62 are normally open, that is, closed when power is applied to the solenoid valve thereof, while valves 64 are normally closed, that is, opened upon application of electric power. The remaining valves, 82, 84, 86, are all normally closed.

Valves 62 being closed and valves 64 being opened for the entire cleaning cycle, as shown in FIG. 4 the valves 62, 64 are maintained throughout the cycle by latching relay 110 through its own normally open contacts 210. Upon closure of initiation contacts 108, stepping switch 116 is advanced to first contact 120. In this position, valves 62, 64 are operated and power is applied to latching relay 110. Power to latching relay 110 is maintained through its own contacts 210, until, at the end of the cycle, unlatching relay 112 breaks contact through its normally closed contacts 212, in series with latching relay 110. In any event, valves 62, 64 remain operative throughout the cleaning cycle.

Stepper 116 is advanced from position to position after a suitable time delay, depending upon the length and diameter of the conduits to be cleaned, the capacity of pump 60, and, the pressure of water at sources 72, 74. Delays from step to step on the order of thirty seconds will generally prove adequate.

As described hereinabove, the successive operation of pump 60, valves 86 (cleaning solution line), 82 (hot rinse), and 84 (cold rinse) alternate in order to drain, clean and rinse the conduits. This succession may be executed using alternate stepping switch contacts, pump 60 being operated at every other step. Finally, unlatching relay 112 releases valves 62, 64 and thereby again connects the beverage supply kegs 32 to the conduit system, after the final drain.

Figure 5A:
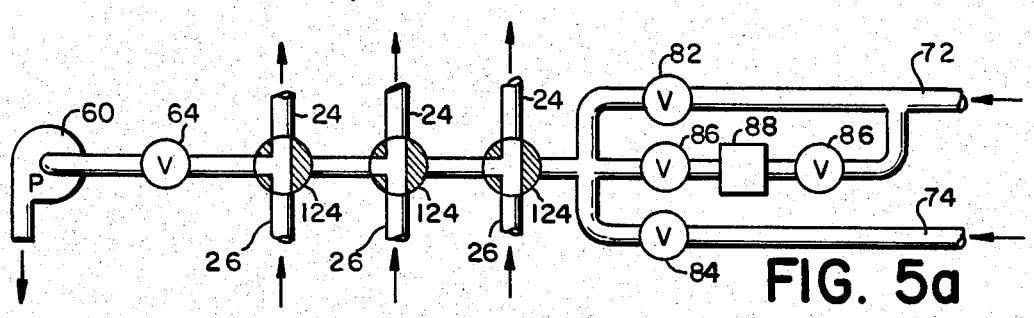
FIG. 5*a* is a schematic view of the system of the invention, adapted to use three-way valves, the valves being in the beverage delivery position; and, FIG. 5*b* is a partial schematic view of the system of FIG. 5*a*, the valves being in the conduit cleaning position.
Figure 5B:
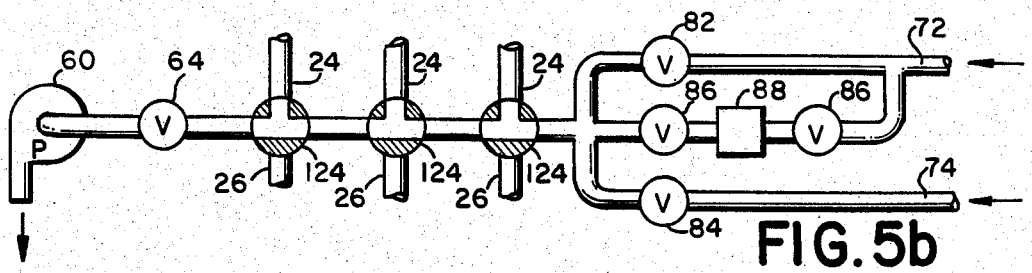

As shown in FIGS. 5*a* and 5*b*, valves 62, 64 may be functionally replaced with single two-way valves for each of the conduits. It is presently preferred that separate valves be employed, in order to provide the additional capability of isolating a single selected conduit 24 from the lead beverage tube 26 associated therewith, for example when changing kegs. If this capability is not required, or if other means are provided to prevent backwash of conduit contents into refrigerator 30 when beverage tube 26 is removed, three-way valves 124 replace the functions of valves 62, 64. As shown in FIG. 5*a*, in the beverage delivery position, lead beverage tubes 26 and conduits 24 are connected, and discharge connections leading to pump 60 are blocked. The three-way valve 124 immediately adjacent pump 60 must be further isolated from pump 60 using one on/off valve 64, as shown in FIG. 5*a*. With reference to FIG. 5*b*, a partial view of the schematic of FIG. 5*a*, in the cleaning position, valves 124 are turned to connect each of the conduits 24 to pump 60, and single valve 64 is opened. In this position, the kegs and their lead lines 26 are isolated from conduits 24 and the cleaning system in general, and no water or cleaning solution is introduced into the kegs.

Although choice of normally-open and normally-closed valves has been made to minimize the effect of a power failure, a loss of power due, for example, to a short circuit in a defective motor 60 or one of the solenoid valves of the automatic cleaning system, will nevertheless make the system entirely inoperational. Such a short will only occur during a cleaning cycle when the conduits may be full of cleaning solution or water. In order to recover beverage delivery, a battery driven backup control is preferably included, for example as part of control 54. The backup control holds valves 62, 64 in their operative positions for a sufficient delay to allow gravity drain of conduits 24 through pump 60.

The invention is capable of a number of additional variations and embodiments, without departing from the spirit thereof. Reference should be made to the appended claims rather than the foregoing specification as indicating the true scope of the invention.

What is claimed is:

1. An automatic cleaning apparatus for beverage delivery systems of the type having at least one conduit for carrying the beverage in a delivery direction from a pressurized beverage source to an output, the apparatus comprising:

a first valve disposed in said conduit and controllably closable to isolate the beverage source from a downstream part of the conduit in said delivery direction;

a pump, and pump valve in series with the pump, an inlet to the pipe being connected to the downstream part of the conduit and an outlet of the pump being connected to a drain, the pump and pump valve controllably operable to provide a fluid connection between the conduit and the drain and operable to forceably discharge the conduit opposite said delivery direction to the drain;

a second valve connecting the downstream part of the conduit and a pressurized clean water source, the second valve being controllably operable to carry clean water to conduit;

a third valve and one-way valve connecting the downstream part of the conduit to an unpressurized cleaning solution reservoir, the one-way valve siphoning cleaning solution from the reservoir to the third valve, and thereby to the conduits; and, a controller connected to the pump and to the first, second and third valves, the controller sequencing operation of the pump and first, second and third valves in a conduit cleaning mode, the controller alternately isolating the beverage source, flushing and draining the conduit with cleaning solution and with clean water.

2. The apparatus of claim 1, wherein the pump defines an unobstructed passage from the drain to the pump valve both when operating and when idle, wherein liquid can drain through the pump by gravity flow.

3. The apparatus of claim 2, wherein said pump is a centrifugal pump.

4. The apparatus of claim 1, further comprising means to periodically automatically initiate a cleaning cycle by triggering the controller.

5. The apparatus of claim 1, further comprising a plurality of conduits, each of said plurality having a first valve to isolate a respective beverage source and each of said plurality having a pump valve, the pump valves being connected in series to the pump.

6. The apparatus of claim 1, further comprising at least one lead beverage tube removably connectable between the pressurized beverage source and the conduit, the lead beverage tube being upstream along the conduit in said beverage delivery direction, the apparatus further comprising means for attaching opposite ends of the lead beverage tube to the drain and to the pressurized clean water source, respectively.

7. The apparatus of claim 6, wherein said means for attaching comprises a standardized keg fitting adapted to receive the lead beverage tube.

8. The apparatus of claim 6, comprising a plurality of conduits, pressurized beverage sources and first valves, the first valves being each independently operable to isolate a respective beverage source from a respective conduit.

9. The apparatus of claim 1, wherein said beverage is draft beer.

10. The apparatus of claim 1, further comprising means for selectably connecting hot and cold water to said pressurized clean water source.

* * * * *